US009676216B2

(12) United States Patent
Colonel et al.

(10) Patent No.: US 9,676,216 B2
(45) Date of Patent: Jun. 13, 2017

(54) SYSTEMS AND METHODS FOR AUTOMATIC PRINTER CONFIGURATION

(71) Applicant: Datamax-O-Neil Corporation, Orlando, FL (US)

(72) Inventors: Kenneth Colonel, Oviedo, FL (US); Richard Hatle, Oviedo, FL (US)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

(21) Appl. No.: 14/670,475

(22) Filed: Mar. 27, 2015

(65) Prior Publication Data

US 2015/0273910 A1 Oct. 1, 2015

Related U.S. Application Data

(60) Provisional application No. 61/971,189, filed on Mar. 27, 2014.

(51) Int. Cl.
*B41J 29/38* (2006.01)
*B41J 11/00* (2006.01)

(52) U.S. Cl.
CPC ..... *B41J 29/38* (2013.01); *B41J 11/009* (2013.01)

(58) Field of Classification Search
CPC ..... B41J 29/393; B41J 11/46; B41J 11/008; B41J 11/009; B41J 29/38
(Continued)

(56) References Cited

U.S. PATENT DOCUMENTS 4,143,977 A 3/1979 Kurihara et al.
4,177,731 A 12/1979 Kleist et al.
(Continued)

FOREIGN PATENT DOCUMENTS

CA 2841613 2/2014
EP 0911699 A2 4/1999
(Continued)

OTHER PUBLICATIONS

European Search Report for EP 12810566 (PCT/US2012046712) dated Mar. 5, 2015; 8 pages.
(Continued)

*Primary Examiner* — Jannelle M Lebron
(74) *Attorney, Agent, or Firm* — Additon, Higgins & Pendleton, P.A.

(57) ABSTRACT

A self-configuring printer includes a print head configured to print on a print media, and a sensor configured to sense indicia on the print media. The indicia includes a top-of-form mark and at least one data segment. The printer includes a processor in operative communication with the sensor and a memory in operative communication with the processor. The memory stores a set of instructions, which, when executed by the processor, cause the processor to execute a method of operating the printer. The method includes receiving, from the sensor, signals corresponding to the a top-of-form mark and the at least one data segment; determining, from the signals, a top-of-form location of the print media and at least one printer operational property; moving the top-of-form location of the print media to a predetermined position with respect to the print head; and configuring the printer utilizing the at least one printer operational property.

8 Claims, 6 Drawing Sheets

(58) Field of Classification Search
USPC ..... 347/14, 16, 19, 101, 104
See application file for complete search history.

(56) References Cited

U.S. PATENT DOCUMENTS

| | | | |
|---|---|---|---|
| 4,699,531 | A | 10/1987 | Ulinski et al. |
| 4,788,558 | A | 11/1988 | Caldwell et al. |
| 4,788,559 | A | 11/1988 | Ende |
| 4,872,659 | A | 10/1989 | Kato et al. |
| 4,924,240 | A | 5/1990 | Herbert et al. |
| 4,991,846 | A | 2/1991 | Sondej |
| 5,028,155 | A | 7/1991 | Sugiura et al. |
| 5,087,137 | A | 2/1992 | Burnard et al. |
| 5,206,662 | A | 4/1993 | Fox et al. |
| 5,326,182 | A | 7/1994 | Hagstrom |
| 5,397,192 | A | 3/1995 | Khormaee |
| 5,468,076 | A | 11/1995 | Hirano et al. |
| 5,488,223 | A | 1/1996 | Austin et al. |
| 5,490,638 | A | 2/1996 | Driftmyer et al. |
| 5,564,841 | A | 10/1996 | Austin et al. |
| 5,600,350 | A | 2/1997 | Cobbs et al. |
| 5,614,934 | A | 3/1997 | Yoshida et al. |
| 5,650,730 | A | 7/1997 | Herbst, Jr. |
| 5,684,516 | A | 11/1997 | Cseledy et al. |
| 5,790,162 | A | 8/1998 | Adams et al. |
| 5,816,165 | A | 10/1998 | Huston |
| 5,820,280 | A | 10/1998 | Fox |
| 5,836,704 | A | 11/1998 | Lau et al. |
| 5,870,114 | A | 2/1999 | Numata et al. |
| 5,874,980 | A | 2/1999 | West |
| 5,909,233 | A | 6/1999 | Hamman et al. |
| 5,927,875 | A | 7/1999 | Lau et al. |
| 5,934,812 | A | 8/1999 | Nunokawa et al. |
| 5,978,004 | A | 11/1999 | Ehrhardt |
| 5,995,128 | A | 11/1999 | Adams et al. |
| 6,014,229 | A | 1/2000 | Yun |
| 6,020,906 | A | 2/2000 | Adams et al. |
| 6,034,708 | A | 3/2000 | Adams et al. |
| 6,042,279 | A | 3/2000 | Ackley |
| 6,047,110 | A | 4/2000 | Smith |
| 6,057,870 | A | 5/2000 | Monnier et al. |
| 6,070,048 | A | 5/2000 | Nonaka et al. |
| 6,082,914 | A | 7/2000 | Barrus et al. |
| 6,095,704 | A | 8/2000 | Jaeger et al. |
| 6,099,178 | A | 8/2000 | Spurr et al. |
| 6,129,463 | A | 10/2000 | Lau et al. |
| 6,201,255 | B1 | 3/2001 | Torchalski et al. |
| 6,283,024 | B1 | 9/2001 | George |
| 6,289,730 | B1 | 9/2001 | Elgee |
| 6,302,604 | B1 | 10/2001 | Bryant et al. |
| 6,335,084 | B1 | 1/2002 | Biegelsen et al. |
| 6,389,241 | B1 | 5/2002 | Cernusak et al. |
| 6,396,070 | B1 | 5/2002 | Christensen et al. |
| 6,520,614 | B2 | 2/2003 | Kaneko |
| 6,582,138 | B1 | 6/2003 | Meunier et al. |
| 6,604,875 | B2 | 8/2003 | Meunier et al. |
| 6,616,362 | B2 | 9/2003 | Bouverie et al. |
| 6,825,864 | B2 | 11/2004 | Botten et al. |
| 6,840,689 | B2 | 1/2005 | Barrus et al. |
| 6,846,121 | B2 | 1/2005 | Bouverie et al. |
| 6,857,714 | B2 | 2/2005 | Hohberger et al. |
| 6,900,449 | B2 | 5/2005 | Bolash et al. |
| 6,934,043 | B1 | 8/2005 | Sugiyama et al. |
| 6,942,403 | B2 | 9/2005 | Hohberger et al. |
| 6,991,130 | B2 | 1/2006 | Presutti et al. |
| 7,040,822 | B2 | 5/2006 | Fries et al. |
| 7,042,478 | B2 | 5/2006 | Bouverie et al. |
| 7,071,961 | B2 | 7/2006 | Ullenius et al. |
| 7,079,168 | B2 | 7/2006 | Ullenius et al. |
| 7,102,798 | B2 | 9/2006 | Haines et al. |
| 7,142,324 | B2 | 11/2006 | Haines |
| 7,150,572 | B2 | 12/2006 | McNestry et al. |
| 7,162,460 | B2 | 1/2007 | Cleckler et al. |
| 7,205,561 | B2 | 4/2007 | Chelvayohan et al. |
| 7,255,343 | B2 | 8/2007 | So |
| 7,324,125 | B2 | 1/2008 | Gustafsson |
| 7,344,323 | B2 | 3/2008 | Fries et al. |
| 7,375,832 | B2 | 5/2008 | Bouverie et al. |
| 7,456,995 | B2 | 11/2008 | Stephens |
| 7,502,042 | B2 | 3/2009 | Hitz et al. |
| 7,537,404 | B2 | 5/2009 | Bouverie et al. |
| 7,600,684 | B2 | 10/2009 | Tobin et al. |
| 7,667,874 | B2 | 2/2010 | MacDonald et al. |
| 7,699,550 | B2 | 4/2010 | Bouverie et al. |
| 7,824,116 | B2 | 11/2010 | Lyman |
| 7,845,632 | B2 | 12/2010 | Windsor et al. |
| 7,857,414 | B2 | 12/2010 | Eun et al. |
| 7,876,223 | B2 | 1/2011 | Yamaguchi et al. |
| 7,891,892 | B2 | 2/2011 | Chiu |
| 7,907,159 | B2 | 3/2011 | Matsuo et al. |
| 7,934,881 | B2 | 5/2011 | Lodwig et al. |
| 7,938,501 | B2 | 5/2011 | Takamiya et al. |
| 8,142,087 | B2 | 3/2012 | Kugimachi |
| 8,412,062 | B2 | 4/2013 | Kielland |
| 8,456,710 | B2 | 6/2013 | Yamamoto |
| 8,556,370 | B2 | 10/2013 | McCready et al. |
| 2001/0008612 | A1 | 7/2001 | Liljestrand et al. |
| 2003/0044189 | A1 | 3/2003 | Okitsu et al. |
| 2003/0053114 | A1* | 3/2003 | Hopper ..... B41J 11/46 358/1.15 |
| 2003/0072028 | A1 | 4/2003 | Haines et al. |
| 2003/0081024 | A1 | 5/2003 | Vives et al. |
| 2003/0132366 | A1 | 7/2003 | Gao et al. |
| 2003/0141655 | A1 | 7/2003 | Bryer |
| 2004/0008365 | A1 | 1/2004 | Hobbs |
| 2004/0114024 | A1 | 6/2004 | Bouverie et al. |
| 2004/0165927 | A1 | 8/2004 | Fisher et al. |
| 2005/0002715 | A1 | 1/2005 | Fries et al. |
| 2005/0189693 | A1 | 9/2005 | Ko |
| 2005/0190368 | A1 | 9/2005 | Ehrhardt, Jr. et al. |
| 2005/0204940 | A1 | 9/2005 | Elliott et al. |
| 2006/0007295 | A1 | 1/2006 | Ueda |
| 2006/0012666 | A1 | 1/2006 | Kim et al. |
| 2006/0045601 | A1 | 3/2006 | Endo |
| 2006/0055721 | A1 | 3/2006 | Burdette et al. |
| 2006/0157911 | A1 | 7/2006 | Learmonth et al. |
| 2006/0159504 | A1 | 7/2006 | Blanchard, Jr. et al. |
| 2006/0180737 | A1 | 8/2006 | Consiglio |
| 2006/0182920 | A1 | 8/2006 | Craig |
| 2007/0022233 | A1 | 1/2007 | Bridges et al. |
| 2007/0040326 | A1 | 2/2007 | Noda et al. |
| 2007/0059078 | A1 | 3/2007 | Silverbrook et al. |
| 2007/0063429 | A1 | 3/2007 | Kang |
| 2007/0127965 | A1 | 6/2007 | Pagan et al. |
| 2007/0138738 | A1 | 6/2007 | Motohashi et al. |
| 2008/0193190 | A1 | 8/2008 | Craig |
| 2009/0038495 | A1 | 2/2009 | Butzen et al. |
| 2009/0103806 | A1 | 4/2009 | Nakami |
| 2009/0244584 | A1 | 10/2009 | McGarry et al. |
| 2009/0261170 | A1 | 10/2009 | Craig |
| 2010/0066782 | A1 | 3/2010 | Yamamoto et al. |
| 2010/0068440 | A1 | 3/2010 | Craig |
| 2010/0090394 | A1 | 4/2010 | You |
| 2010/0169513 | A1 | 7/2010 | Levin |
| 2010/0247222 | A1 | 9/2010 | Bouverie et al. |
| 2010/0319561 | A1 | 12/2010 | Colquitt et al. |
| 2011/0042883 | A1 | 2/2011 | Wang et al. |
| 2011/0132643 | A1 | 6/2011 | Hattori et al. |
| 2013/0016368 | A1 | 1/2013 | Bouverie et al. |
| 2013/0099142 | A1 | 4/2013 | Bouverie et al. |
| 2015/0154892 | A1 | 6/2015 | Craig |

FOREIGN PATENT DOCUMENTS

| | | |
|---|---|---|
| EP | 2731797 | 1/2013 |
| JP | 2000-141775 A | 5/2000 |
| JP | 04552558 B2 | 9/2010 |
| WO | 95/24316 | 9/1995 |

(56) References Cited

FOREIGN PATENT DOCUMENTS

| | | | |
|---|---|---|---|
| WO | 2004/114257 | A2 | 12/2004 |
| WO | 2013010097 | A1 | 1/2013 |

OTHER PUBLICATIONS

International Search Report for PCT/US2012/46712; dated Oct. 5, 2012; 8 pages.
Written Opinion for PCT/US2012/050938; dated Nov. 6, 2012; 7 pages.
Written Opinion for PCT/US2012/036297; dated Jul. 17, 2012; 5 pages.
Written Opinion for PCT/US2012/039043; dated Aug. 3, 2012; 4 pages.
Written Opinion for PCT/US2012/041093; dated Aug. 7, 2012; 7 pages.
Written Opinion for PCT/US2012/043709; dated Sep. 21, 2012; 5 pages.
Written Opinion for PCT/US2012/043734; dated Sep. 21, 2012; 5 pages.
Written Opinion for PCT/US2012/043772; dated Sep. 14, 2012; 8 pages.
Written Opinion for PCT/US2012/046712; dated Oct. 5, 2012; 5 pages.
Written Opinion for PCT/US2012/049417; dated Nov. 2, 2012; 7 pages.
Written Opinion for PCT/US2012/060956; dated Jan. 11, 2013; 7 pages.
Written Opinion for PCT/US2012/066291; dated Feb. 5, 2013; 8 pages.
Search Report and Written Opinion in commonly owned European Application No. 15161521.8 dated Dec. 17, 2010, pp.1-8 [WO 2013/010097 and U.S. Pat. No. 5,564,841 previouly cited; US 2013/009142 is commonly owned and cited on separate IDS.].
Bosch Home Appliances, "Tassimo Manual for TAS451xUC and TAS 1000UC", Dated Jul. 24, 2009; Downloaded Feb. 9, 2015 from http://www.manualslib.com/download/355220/Bosch-Tas1000uc.html; 62 pages.

* cited by examiner

SYSTEMS AND METHODS FOR AUTOMATIC PRINTER CONFIGURATION

CROSS REFERENCE TO RELATED APPLICATIONS

This application claims priority to U.S. Provisional Patent Application No. 61/971,189 entitled "SYSTEMS AND METHODS FOR AUTOMATIC PRINTER CONFIGURATION", filed Mar. 27, 2014, the contents of which are hereby incorporated by reference.

BACKGROUND

Technical Field

The present disclosure relates to continuous feed printers, and more particularly, to a portable label or thermal printer configured to perform self-calibration in response to indicia encoded on media.

Background of Related Art

Portable or desktop printers used in many settings, e.g., in warehouses, in industrial and manufacturing environments, by shipping services, in the vending and gaming industries, and in retail establishments for ticket printing and inventory control. Ideally, portable printers weigh only a few pounds, and some are small enough to be easily carried during use and/or easily attached to a buckle or a harness-type device. This enables the user to print labels or receipts on demand without having to retrieve a printed label from a printing station. Because the printer is portable, the printer may include a power source, such as a disposable or rechargeable battery, and may additionally communicate with a host terminal or network connection via a wireless interface, such as a radio or optical interface. A portable printer may utilize sheet-fed media, or, more popularly, continuous-feed media, e.g., rolls of paper, labels, tags, and the like. Portable printers commonly employ direct thermal transfer techniques, whereby thermochromic media passes over a thermal print head which selectively heats areas of the media to create a visible image. Also popular are thermal transfer printers which employ a heat-sensitive ribbon to transfer images to media.

A continuous feed printer is particularly suitable for printing onto stock material which may include, but is not necessarily limited to, labels, receipts, item labels, shelf labels/tags, ticket stubs, stickers, hang tags, price stickers, and the like. Label printers may incorporate a media supply of "peel away" labels adhered to a coated substrate wound in a rolled configuration. Alternatively, a media supply may include a plain paper roll suitable for ink-based or toner-based printing. Continuous media is typically supplied in rolls, and is available in various widths. The roll media may be wound around a generally tubular core which supports the roll media. The core may have a standard size, or arbitrarily-sized inner diameter. In use, the media is drawn against a printing head, which, in turn, causes images to be created on the media stock by, e.g., impact printing (dot matrix, belt printing), by localized heating (direct thermal or thermal transfer printing), inkjet printing, toner-based printing, or other suitable printing methods.

Portable or thermal printers may be designed for use with many different types of print media. Each different type of print media may have particular properties which affect the printing process, for example, media type (direct thermal, thermal transfer, impact, etc.), label length, label width, thermal transfer characteristics, surface texture, color, manufacturing date and lot number, and so forth. When a user loads media into a printer, he or she may need to provide, typically using a control panel or other user interface device, one or more media parameters to the printer to ensure that images printed on the media are properly rendered. For example, if a thermal printhead provides insufficient heat to a particular type of thermal media, the resulting label may appear washed out or unreadable. The manual entry of media parameters may be error-prone. In addition, if a user fails to enter the necessary media parameters, labels may be wasted and/or other inefficiencies or unforeseen consequences may ensue.

SUMMARY

The present disclosure is directed to self-configuring printer. In one embodiment in accordance with the present disclosure, the self-configuring printer includes a print head configured to print on a print media, and a sensor configured to sense indicia on the print media. The indicia includes a top-of-form mark and at least one data segment. The printer includes a processor in operative communication with the sensor and a memory in operative communication with the processor. The memory stores a set of instructions, which, when executed by the processor, cause the processor to execute a method of operating the printer. The method includes receiving, from the sensor, signals corresponding to the a top-of-form mark and the at least one data segment; determining, from the signals, a top-of-form location of the print media and at least one printer operational property; moving the top-of-form location of the print media to a predetermined position with respect to the print head; and configuring the printer utilizing the at least one printer operational property.

In some aspects the at least one data segment includes at least one mark and at least one space. The at least one mark and the at least one space are decoded to form a bit mapped representation.

In some aspects the at least one printer operational property includes one or more digital codes that includes thermal print heat settings. The thermal print heat settings include a temperature, a print speed, a minimum temperature, a maximum temperature, a ramp-up time, a ramp-down time, a security indicator, and/or an authentication indicator. The at least one printer operational property may also include a number of sheets or a number of remaining sheets.

In another embodiment of the present disclosure, media for use in a printer is provided. The media includes a top-of-form mark and the at least one data segment. The at least one data segment includes at least one mark and at least one space. The at least one mark and the at least one space are decoded to form a bit mapped representation.

In some aspects the at least one printer operational property includes one or more digital codes that includes thermal print heat settings. The thermal print heat settings include a temperature, a print speed, a minimum temperature, a maximum temperature, a ramp-up time, a ramp-down time, a security indicator, and/or an authentication indicator. The at least one printer operational property may also include a number of sheets or a number of remaining sheets.

BRIEF DESCRIPTION OF THE DRAWINGS

Various embodiments of the subject instrument are described herein with reference to the drawings wherein.

DETAILED DESCRIPTION

Figure 1:
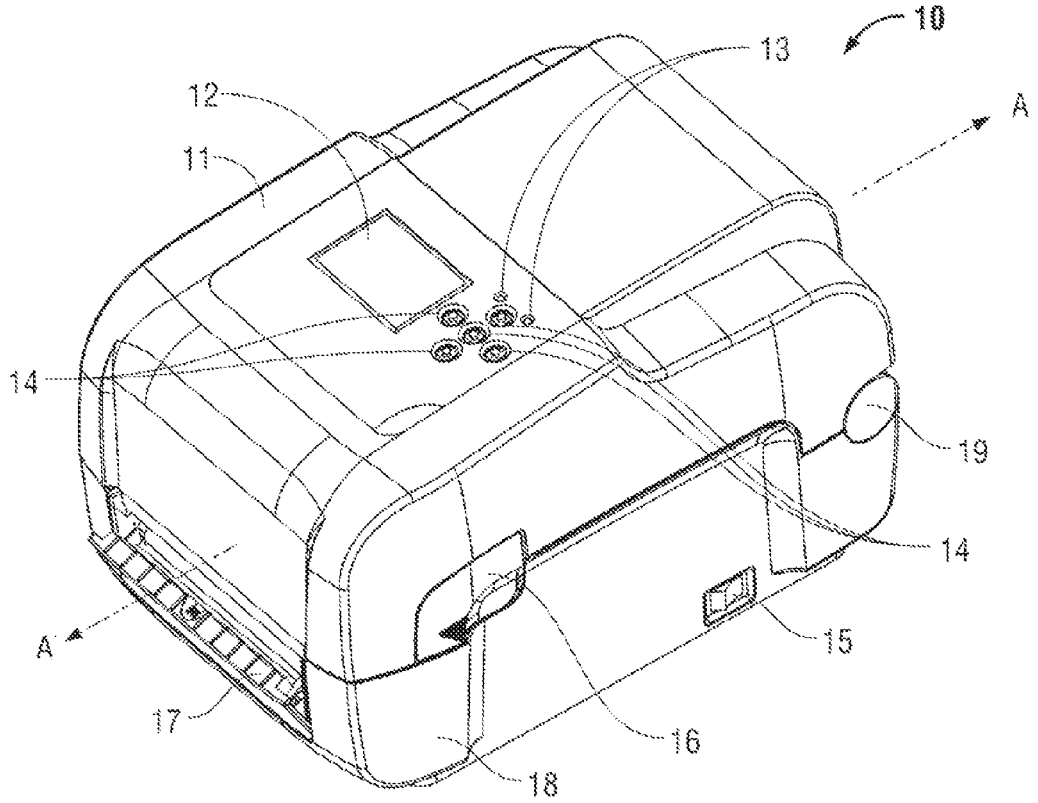
FIG. 1 is a view of an embodiment of self-configuring printer in accordance with the present disclosure showing a cover in a closed configuration.

Particular embodiments of the present disclosure are described hereinbelow with reference to the accompanying drawings; however, it is to be understood that the disclosed embodiments are merely exemplary of the disclosure, which may be embodied in various forms. Well-known and/or repetitive functions and constructions are not described in detail to avoid obscuring the present disclosure in unnecessary or redundant detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In addition, as used herein, terms referencing orientation, e.g., "top," "bottom," "up," "down," "left," "right," "clockwise," "counterclockwise," and the like, are used for illustrative purposes with reference to the figures and features shown therein. It is to be understood that embodiments in accordance with the present disclosure may be practiced in any orientation without limitation. In this description, as well as in the drawings, like-referenced numbers represent elements which may perform the same, similar, or equivalent functions. In the drawings and description, any dimensions should be understood to represent example embodiments and are not to be construed as limiting. The word "exemplary" is used herein to mean "serving as an example, instance, or illustration." Any embodiment described herein as "exemplary" is not necessarily to be construed as preferred or advantageous over other embodiments. The word "example" may be used interchangeably with the term "exemplary."

Figure 2:
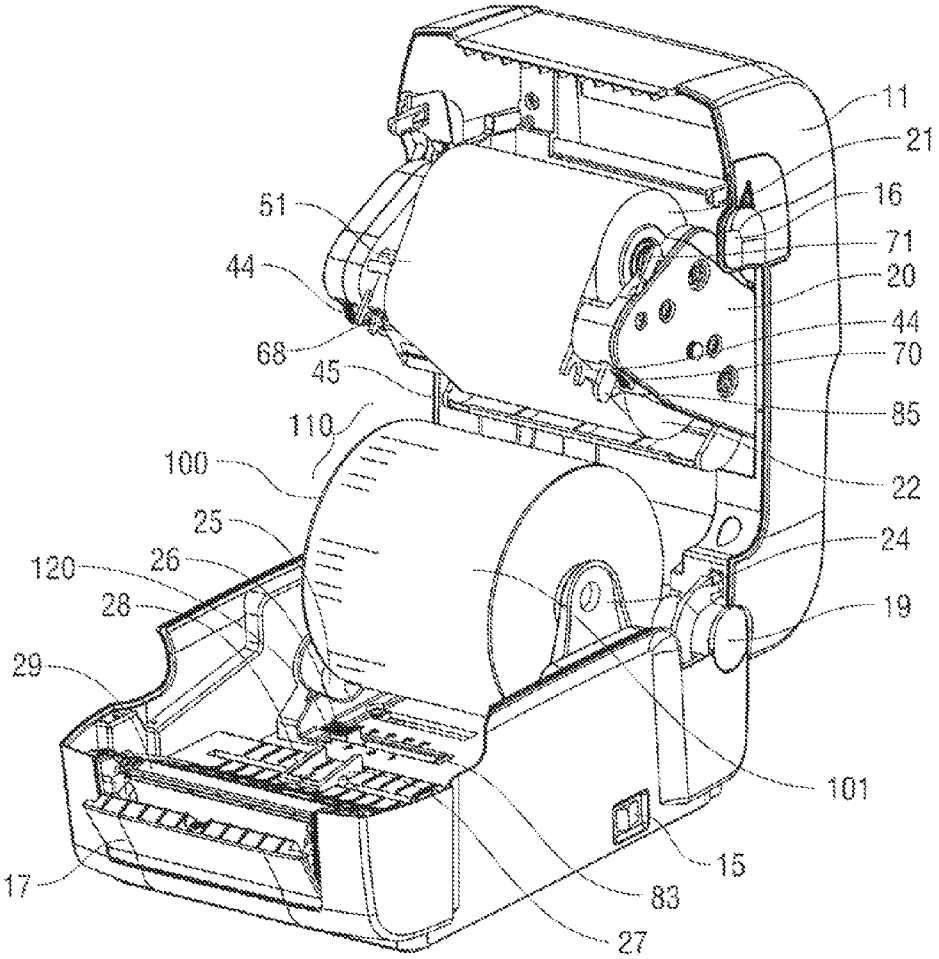
FIG. 2 is a view of an embodiment of the self-configuring printer of FIG. 1 showing a cover in an open configuration.
Figure 3:
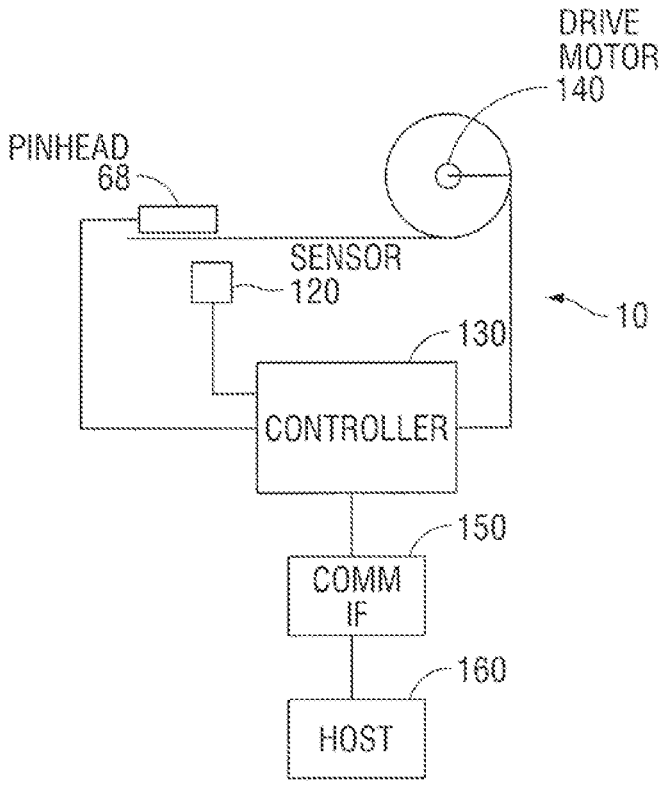
FIG. 3 is a block diagram of an embodiment of a self-configuring printer in accordance with the present disclosure.

FIGS. 1 and 2 illustrate an example embodiment of a printer 10 in accordance with the present disclosure. The printer 10 includes a bottom housing 18 and a selectively positionable top cover 11 that may be positioned in a closed position as shown in FIG. 1 and an open position as shown in FIG. 2. Top cover 11 and bottom housing 18 are pivotably joined by a hinge 19. Top cover 11 includes a user interface panel 12, one or more user input devices 14, and one or more indicators 13. User interface panel 12 many include any suitable form of display panel, including without limitation an LCD screen. User input device may include any suitable form of input device, e.g., a snap dome or membrane pushbutton switch. Indicator 13 may be any suitable indication, such as without limitation a light-emitting diode (LED). Indicator 13 may illuminate to indicate the status an operational parameter, e.g., power, ready, media empty, media jam, self-test, and the like. Printer 10 includes a power switch 15. A pair of latches 16 are disposed on either side of top cover 11 to retain top cover 11 in a closed position, and may be disengaged using finger pressure to facilitate opening of top cover 11. A media door 17 provides an alternative point of egress for media, which may be advantageous with self-adhesive labels whereby the labels peel away from the substrate upon exiting the printer.

Turning to FIG. 2, top cover 11 includes a print frame assembly 20 pivotably mounted therein. Print frame assembly 20 includes a ribbon supply roll 22 and a ribbon take up roll 21 that are arranged to supply transfer ribbon 51 across a print head 68. Print frame assembly 20 is selectively positionable between an open position as shown in FIG. 2 and a closed position as shown in FIG. 2A. Print frame assembly 20 includes a latch 71 that engages a retaining pin (not explicitly shown) provided within top housing 11 to retain print frame assembly 20 in a closed position. A release 70 is operatively associated with latch 71 that, when depressed, releases latch 71 from the retaining pin to enable print frame assembly 20 to swing outward to an open position.

Printer 10 includes a first and a second media support members 24, 25, respectively, that are configured to support roll media 100 held therebetween. Media support members 24 and 25 are moveable along a transverse axis and are operatively associated with a reciprocal movement mechanism (not explicitly shown) that is configured to translate a transverse movement of first media support member 24 into a corresponding opposite transverse movement of second media support member 25, and vice versa. By this arrangement, roll media 100 of arbitrary width may be accommodated while concurrently centering roll media 100 with respect to the longitudinal axis "A-A" of the print head 68 and thus to the centerline of a feed path 76 corresponding thereto. First and a second media support members 24, 25 may be biased inwardly, e.g., toward the centerline, by a biasing member, e.g., a spring (not explicitly shown), to aid in gripping media roll 100 between the support members 24, 25. A selectively adjustable stop 26 enables the position of media support members 24, 25 to be preset. Stop 26 is slidably disposed within an elongate slot 83 transversely defined in feed path 76 of lower chassis 34. Stop 26 and elongate slot 83 are configured to provide sufficient friction therebetween to enable stop 26, when positioned, to overcome the inward biasing force of media support members 24, 25 and maintain media support members 24, 25 in the desired position.

A first media guide member 27 and a second media guide member 28 are moveable along a transverse axis and are operatively associated with a second reciprocal movement mechanism (not explicitly shown) that is configured to translate a transverse movement of first media guide member 27 into a corresponding opposite transverse movement of second media support member 28, and vice versa. A platen roller 29 opposes print head 68 when top cover 11 is in the closed position to ensure intimate contact between print head 68, transfer ribbon 51, and media 100 during use, which, in turn, promotes consistent high print quality. Print head 68 includes pair of saddles 44 that engage a portion of platen roller 29 to ensure precise alignment between print head 68 and platen roller 29 when top cover 11 is in a closed position.

Figure 1A:
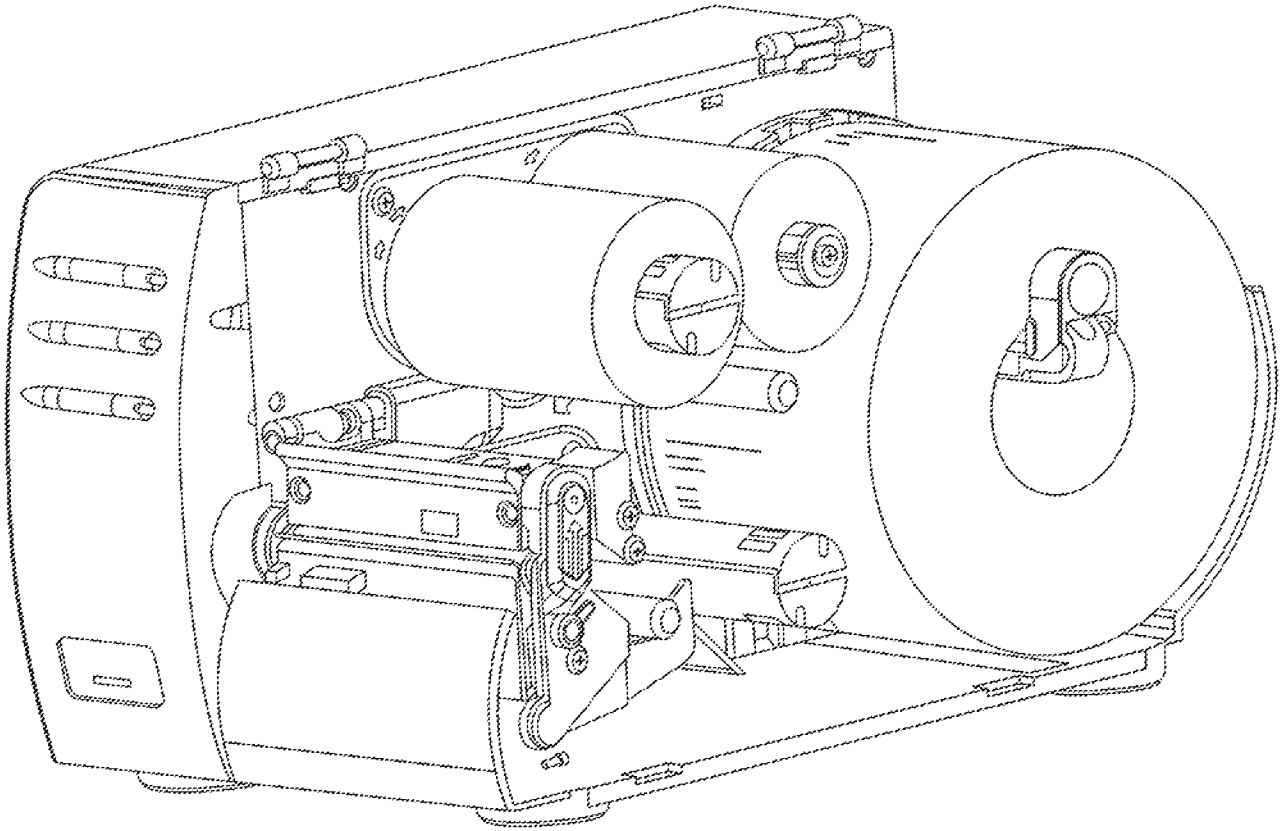
FIG. 1A is a view of another embodiment of self-configuring printer in accordance with the present disclosure having a modular construction.

In another aspect, as shown in FIG. 1A, embodiments of the present disclosure include a modular printer having a media take-up assembly, a support block assembly, a printhead assembly, a stepper motor assembly and a display assembly is provided. A support housing having a plurality of recesses formed on an internal wall of the modular printer is also provided. Each of the recesses is configured to receive and align one of the modular printer assemblies with the other modular printer assemblies. Each of the assemblies is configured as a module which can be easily accessed and quickly secured to or detached from the support housing. The support housing is adapted to receive assembly modules for both thermal ink printers and ribbon ink printers such that the modular printer can be easily converted from one to the other.

For a detailed description of the construction and operation of exemplary printers which may be utilized in accordance with embodiments of the present disclosure, reference may be made to U.S. Pat. No. 5,326,182, filed Sep. 14, 1992, U.S. Pat. No. 7,042,478, filed Sep. 22, 2003, and U.S. Pat. No. 8,500,351, filed Dec. 21, 2010, the entire contents of each of which are hereby incorporated herein by reference.

Media 100 includes indicia 110 printed on the back side 101 of the media which is encoded with media properties, printer settings, and/or any other desired information. Printer 10 includes a sensor 120 that is configured to read indicia 110 as media 100 advances through the printer 10. In embodiments, sensor 120 may include a light source and a light sensor, such as an LED and a phototransistor, to facilitate the reading of indicia 110. Sensor 120 is in operative communication with a controller 130. Controller 130 is in operative communication with print head 68, a drive motor 140, and a communications interface 150. In use, communications interface communicates with a host computer 160 to communicate print commands to controller 130. Controller 130 includes a processor and a set of instructions which, when executed on the processor, cause the processor to receive a signal indicative of the indicia 110, to adjust a printing parameter in accordance with the signal, and to cause drive motor 140 and/or print head 68 to print a desired pattern (e.g., text, graphics, etc.) onto a media 100.

Embodiments in accordance with the present disclosure have several novel characteristics. A single sensor 120 may be used to detect both top-of-form and media settings, which reduces manufacturing costs. The media 100 includes indicia 110, which may include a barcode, in which is encoded at least one of media parameters, printer parameters, a label parameter, and a label count (total labels, number of labels remaining, etc.) In one advantageous aspect, a printer 10 in accordance with the present disclosure may be configured to issue an alert (e.g., to a user and/or to a host computer) when a predetermined number of labels is remaining on the media roll 100. As the media 100 advances through printer 10, sensor 120 detects the indicia 110, and conveys the indicia information to controller 130. The indicia is decoded, and the decoded data is utilized to set the various printing parameters of the printer 10. In embodiments, an arbitrary number of parameters may be encoded in the indicia and extracted therefrom. In embodiments the indicia comprises one or more digital codes that contains thermal print heat settings, including without limitation a temperature, a print speed, a minimum temperature, a maximum temperature, a ramp-up time, a ramp-down time, a security indicator, and/or an authentication indicator. The indicia may additionally or alternatively include the number of sheets or pages total and/or remaining on media 100. In these embodiments, when the printer cover is opened, and new media is loaded therein, the indicia provides the number of expected pages. The printer can initiate a page count which then can be used to signal a media low condition and/or a media empty condition. The status can be communicated to the host for workflow and/or logistics management.

Figure 4:
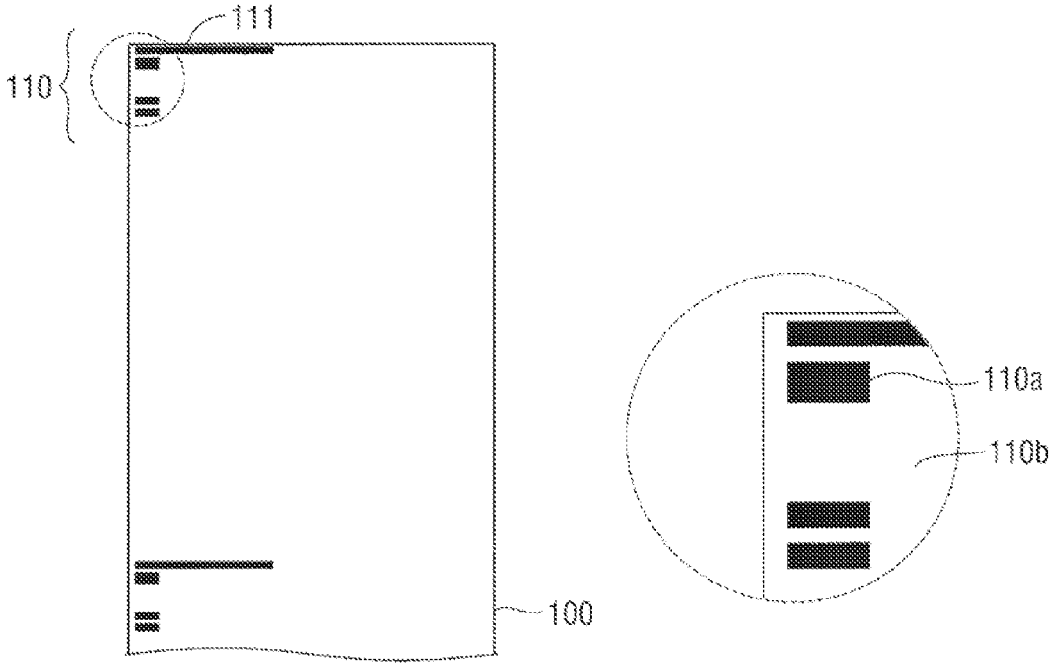
FIG. 4 is a view of an embodiment of encoded media in accordance with the present disclosure.
Figure 5:
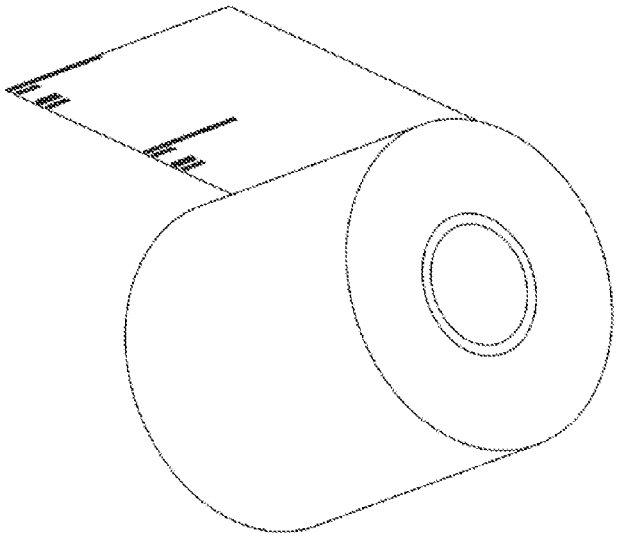
FIG. 5 is a view of another embodiment of encoded media in accordance with the present disclosure.
Figure 6:
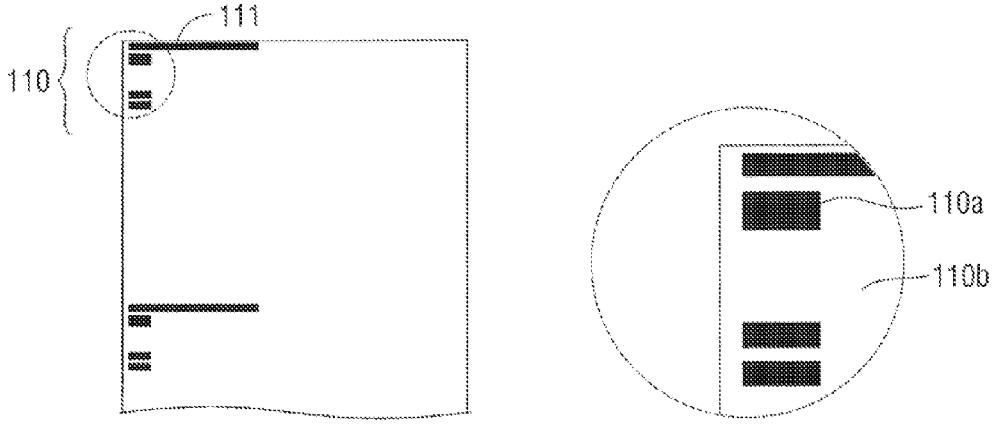
FIG. 6 is a view of yet another embodiment of encoded media in accordance with the present disclosure.

With additional reference to FIGS. 4-6, in an embodiment, a printer in accordance with the present disclosure is configured advance media 100 through printer 10 to identify a top of form block 111 and marks 110*a*/spaces 110*b* of indicia 110. Initially, a leading edge of top-of form (TOF) block 111 is detected and its position recorded. In embodiments, TOF detection is performed by identifying a filtered (de-noised) transition between light and dark areas based on a calibrated threshold level. In embodiments, an automated gain control (AGC) arrangement may be utilized to improve detection accuracy. TOF detection is temporarily disabled for 1.5" and TOF readings are recorded at each full step for next 1.5". After these readings are performed, the data is decoded.

In one embodiment, the indicia encoded on the media is decoded by populating a bit mapped representation of the dark and light (e.g., mark 110*a* and space 110*b*) segments which make up the indicia (e.g., barcode). In embodiments, the bit mapped representation may be stored in a processor register, in memory, and/or may be encoded using any suitable data type (integer, string, Boolean, and so forth). Each bit represents one position of the encoded indicia at which a segment may be present. Initially, each bit position is set to zero, which represents the binary (bit) value indicative of a space. In the present embodiment, the individual bits are assembled into a bit string of any desired length (e.g., 8 bits, 16, bits, 32, bits, 11 bits, etc.) sufficient in length to represent the number of expected segments. For each ⅛" segment of media, up to a predetermined maximum number of segments, the number of high readings in a segment that are above a threshold level (e.g., appearing as dark areas) is counted. If the number of high readings in a segment is larger than 85%, the segment bit is determined to be a 1 (e.g., a mark). If the number of low readings in a segment is larger than 85%, the segment bit is determined to be 0. If neither number of high or low readings exceeds 85%, the segment is deemed invalid. In this event, in some embodiments, the printer may advance to the next TOF block and re-attempt the decoding and/or indicate an error condition.

Once a segment bit is identified, the resultant bit string is shifted once to the left and the segment bit is written into its respective position into the resultant bit string. In some embodiments, a Boolean OR function is performed to a write the segment bit into the bit string. The consequent marks and space segments of the indicia are iteratively identified in the manner just described, until all segments counted. The results are validated by assuring that a leading sync code is "1-0" and a termination code "0-1" have been identified. The sync code and the termination code are stripped from the resultant bit string, and the middle binary code is extracted as the final indicia content, which, in turn, may be used directly to set printer characteristics, and/or used as an index into a printer setup table. The printer setup table is configured to provide one or more printer configuration properties as a function of the index. The printer characteristics may be configured based upon one or more the printer configuration properties provided by the printer setup table.

In one embodiment, a 0.12" high black bar is used to represent one segment. In other embodiments, this can be increased or decreased based on the sensor detection accuracy and the print speed. In some embodiments, the TOF mark may be greater than, or less than, the width that is used to represent one segment. In this manner, a TOF mark is discernable from a segment mark, which facilitates the use of a single sensor to detect both top-of-form properties and media parameter properties of a supply of media.

The described embodiments of the present disclosure are intended to be illustrative rather than restrictive, and are not intended to represent every embodiment of the present disclosure. Further variations of the above-disclosed embodiments and other features and functions, or alternatives thereof, may be made or desirably combined into many other different systems or applications without departing from the spirit or scope of the disclosure as set forth in the following claims both literally and in equivalents recognized in law.

What is claimed is:

1. A printer, comprising:

a print head configured to print on a plurality of print media sheets;

a sensor configured to sense indicia on each of the plurality of print media sheets, the indicia comprising:

a top-of-form mark and at least one data segment encoding a number of remaining print media sheets, comprising:

at least one mark, and at least one space, the one mark and the one space together forming a bit mapped representation when decoded;

a processor in operative communication with the sensor;

a memory in operative communication with the processor, the memory storing a set of instructions, which, when executed by the processor, cause the processor to execute a method of operating the printer, comprising:

receiving, from the sensor, signals corresponding to the a top-of-form mark and the at least one data segment;

determining, from the signals, a top-of-form location of the print media and at least one printer operational property;

moving the top-of-form location of the print media to a predetermined position with respect to the print head; and configuring the printer utilizing the at least one printer operational property.

2. The printer of claim 1, wherein the at least one data segment further includes a number of sheets.

3. The printer of claim 1, wherein the at least one data segment further includes one or more digital codes that include thermal print heat settings.

4. The printer of claim 3, wherein the thermal print heat settings include a temperature, a print speed, a minimum temperature, a maximum temperature, a ramp-up time, a ramp-down time, a security indicator, and/or an authentication indicator.

5. Media for use in a printer, the media comprising:

a plurality of sheets;

a top-of-form mark; and at least one data segment on each of the plurality of sheets, the data segment including:

at least one mark; and at least one space, wherein the at least one mark and the at least one space are decoded to form a bit mapped representation; and wherein the at least one data segment includes encoding a number of remaining sheets of the media.

6. The media of claim 5, wherein the at least one data segment further includes a number of sheets.

7. The media of claim 5, wherein the at least one data segment further includes one or more digital codes that include thermal print heat settings.

8. The media of claim 7, wherein the thermal print heat settings include a temperature, a print speed, a minimum temperature, a maximum temperature, a ramp-up time, a ramp-down time, a security indicator, and/or an authentication indicator.

* * * * *